US008789893B2

(12) United States Patent
Reinhardt

(10) Patent No.: US 8,789,893 B2
(45) Date of Patent: Jul. 29, 2014

(54) DEVICE FOR THE CUTTING AND MIXING OF SOILS

(75) Inventor: Wolfgang Reinhardt, Enger (DE)

(73) Assignee: Allu Deutschland GmbH, Bünde (DE)

( * ) Notice: Subject to any disclaimer, the term of this patent is extended or adjusted under 35 U.S.C. 154(b) by 241 days.

(21) Appl. No.: 12/934,285

(22) PCT Filed: Mar. 26, 2009

(86) PCT No.: PCT/EP2009/053606

§ 371 (c)(1),
(2), (4) Date: Dec. 14, 2010

(87) PCT Pub. No.: WO2009/118386

PCT Pub. Date: Oct. 1, 2009

(65) Prior Publication Data

US 2011/0089745 A1 Apr. 21, 2011

(30) Foreign Application Priority Data

Mar. 26, 2008 (DE) ..... 10 2008 016 673

(51) Int. Cl.
*E02F 5/08* (2006.01)

(52) U.S. Cl.
USPC ..... 299/78

(58) Field of Classification Search
USPC ..... 299/39.4, 78, 39.8, 41.1; 37/189, 462; 405/267
See application file for complete search history.

(56) References Cited

U.S. PATENT DOCUMENTS

| | | | | |
|---|---|---|---|---|
| 4,755,001 A | | 7/1988 | Gilbert | |
| 5,035,071 A | | 7/1991 | Stoetzer | |
| 5,199,195 A | * | 4/1993 | Scordilis et al. | 37/350 |
| 5,304,016 A | | 4/1994 | Kunito | |
| 5,678,639 A | | 10/1997 | Golden | |
| 6,193,444 B1 | * | 2/2001 | Jonninen | 405/258.1 |
| 6,626,500 B1 | | 9/2003 | Cribb et al. | |
| 2006/0037218 A1 | * | 2/2006 | Stoetzer | 37/352 |
| 2006/0053665 A1 | * | 3/2006 | Arzberger et al. | 37/352 |

FOREIGN PATENT DOCUMENTS

| | | | |
|---|---|---|---|
| DE | 2629284 A | * | 1/1978 |
| DE | 19858151 A1 | | 6/2000 |

(Continued)

OTHER PUBLICATIONS

Machine translation of EP 1273411 document Nov. 1, 2013.*

*Primary Examiner* — Sunil Singh
(74) *Attorney, Agent, or Firm* — Gudrun E. Huckett

(57) ABSTRACT

The device for cutting and mixing of soils can be adapted to standard-equipped hydraulic excavators and facilitates the continuous cutting of sealing and stabilizing slits and mixing of stabilizing additives. The device is designed as a rotating and traversing combination tool. The cutting-mixing unit consists of a cutting drum (1) and a mixing drum (4) mounted on a common shaft in an upright housing (3). The cutting drum, which is equipped with front and peripheral teeth, loosens the soil to be processed. By disposing the cutting and breaking tools (2) at the front and periphery of the cutting drum, the loosened soil moves in the direction of the subsequent mixing drum. The mixing drum comprises a plurality of blades (5) separated by a distance along the peripheral surface arranged such that a flow arises opposite to the feed direction, said flow processing the loosened soil into a flowing mixture comprising the additives and the mixing water, said flowing mixture filling in the resultant slit.

9 Claims, 2 Drawing Sheets

(56) References Cited

FOREIGN PATENT DOCUMENTS

| | | | | |
|---|---|---|---|---|
| DE | 10 2006 014 301 | A1 | | 10/2006 |
| EP | 0906990 | A | | 4/1999 |
| EP | 1273411 | A | | 1/2003 |
| EP | 1273411 | A2 | * | 1/2003 |
| EP | 1580398 | A | | 9/2005 |
| EP | 1580398 | A1 | * | 9/2005 |
| WO | 03033826 | A1 | | 4/2003 |

* cited by examiner (12)

DEVICE FOR THE CUTTING AND MIXING OF SOILS

BACKGROUND OF THE INVENTION

The invention concerns a device for cutting and mixing soils that is adaptable to standard hydraulic excavators and that combines continuous cutting of sealing and stabilization trenches with admixture of stabilizing aggregates in a machinery unit.

For producing seals relative to dammed-up or flowing water in ground construction, such as embankments, dams, foundations, or river banks, ditch-like trenches are introduced. These trenches are subsequently filled with suspensions that are adjusted to be flowable and comprised of excavated soil, water, clay minerals, cement or lime. After curing of the suspension, the solidification, or physical separation of the water, a water-impermeable layer is formed.

A similar method is employed for stabilization of sections in the area of roads and rail tracks which sections are prone to settle or slide.

The introduction of trenches into the construction ground is done continuously or discontinuously.

In continuous methods, chain cutters are used wherein the components of the suspension are supplied to the trench and admixed during cutting. The main problem of this method is that the cutter chain has twice the length of the cutter boom and is therefore very heavy. Moreover, in case of a chain-shaped cutting tool approximately one half of the individual cutting tools are always in engagement which requires a power output design in accordance with maximum cutting depth. The total mass of a carrier machine with such a chain-shaped cutting device is at 3 m of trench depth almost 80 t and is therefore no longer suitable for soft soil, construction sites with minimal carrying capacity of the soil, or narrow roadside emergency lanes. Moreover, the machine is expensive and transport to and from the construction site is very complex with regard to logistics. This technology is therefore only suitable for large construction sites with appropriate soil conditions.

Such a trench cutter excavator with the aforementioned disadvantages is disclosed in the publication DE 198 58 151 A1.

In addition, the company ALLU Finland Ltd. offers a soil processing system for stabilizing soft soils, in particular clay, peat and slurry soils.

In this connection, a hydraulic mixing device as an excavator attachment is used that by means of two horizontally arranged drums mixes the soft soil with a supplied suspension or a binder. The drums that rotate in three planes ensure in this connection a controlled thorough mixing of the soil to be stabilized.

The excavator, as attachment carrier, moves in this connection horizontally at a right angle to the axis of rotation of the mixing drums. With this device working depths of five meters can be realized. The device is suitable however exclusively for stabilizing soft soils.

In discontinuous methods for introducing trenches first several bores that are adjoining each other are introduced with vertically operating mast-guided cutter heads. In this connection, the loosened soil is generally conveyed out of the trench area, a suspension is added and admixed, and then the mix is refilled into the produced trench as a plastic or flowable mass.

For this purpose, special excavator carriages are used that are redesigned as drilling machines with masts. In this connection, advancing requires a continuous repositioning of the excavator. A disadvantage is that the production of the trenches by introducing several adjoining boreholes and the introduction of the mixture of excavated soil and suspension that is adjusted to be flowable is temporally separated and is realized with different equipment. A further disadvantage resides in that the thus produced cut-off trenches are geometrically comprised of a number of overlapping or contacting boreholes so that upon refilling no uniform, and thus long-term stability, water-resistant sealing action can be ensured.

SUMMARY OF THE INVENTION

The object of the invention is to eliminate the known disadvantages of the prior art and to propose a simple and inexpensive device for cutting and mixing soils that is adaptable to standard hydraulic excavators and that enables continuous cutting of sealing and stabilization trenches as well as the simultaneous admixture of stabilizing aggregates.

According to the invention this is object is solved by the features of the independent claim. Preferred embodiments are disclosed in the dependent claims.

The device according to the invention for cutting and mixing soils for stabilization of soil materials in trench-shaped soil bodies is embodied as rotating and movable combination tool. The cutting and mixing unit is comprised of a cutting drum and a mixing drum which are supported on a common shaft in a shaft housing.

The cutting drum that is provided with teeth at the end face and circumference loosens the soil to be processed. By the arrangement of the cutting and breaking tools on the end face and the circumference of the cutting drum, the loosened soil is moved in the direction of the downstream mixing drum. The mixing drum has on the circumferential surface a number of spaced apart vanes that are arranged such that a stream is produced in axial direction opposite to the advancing direction and that process the loosened soil with the supplied aggregates and the mixing water to a flowably adjusted mixture that fills the produced trench.

The use of exchangeable hard metal-equipped cutting and breaking tools enables higher advancing speeds and a substantially continuous operation even for a limited amount of rubble and weathered rock.

Advantageously the cutting or breaking tools on the end face of the cutting drum are arranged close to the circumference. Advantageously, the cutting tools that are arranged on the circumference form a spiral line that conveys toward the shaft housing. Moreover, advantageously the commonly driven cutting and mixing drums are supported on a common shaft in the shaft housing.

In an alternative, also preferred, arrangement the cutting and mixing drums are separately driven so that as a function of the soil conditions the rotary speed or the circumferential speed and/or the torque of both drums can be controlled or regulated independently.

In an alternative, also preferred, arrangement the common d rive shaft for the cutting and mixing drums is driven by a conical gear set and a vertical shaft.

Moreover, the shaft housing is closed off by an upper connecting housing that receives the drive motor for the vertical shaft and the connecting surface for receiving the lifting mast or, in case of minimal working depth, is directly mounted by means of a connecting plate to the boom of the excavator.

In a further advantageous embodiment, the supply lines forwater and the aggregate are mounted on the shaft housing and open at the center axis of the cutting and mixing shaft such that aggregates are supplied directly at the mixing location.

It is moreover advantageous that the lifting mast, that has the device for cutting and mixing arranged at its bottom end by means of cables, is supported in a slidable way on a guide unit.

In a further preferred embodiment the guide unit is arranged on the boom of an excavator to be pivotable in a vertical plane that is positioned in the direction of the trench axis or on a support frame at the front end.

In another preferred embodiment the position of the exchangeable cutting and breaking tools on the end face and/or the circumferential surface of the cutting drum is adjustable. In another preferred embodiment, the position of the vanes and/or their engagement angle relative to the longitudinal axis of the mixing drum is adjustable. In this way, there is the possibility to adjust the device individually to a given soil condition.

BRIEF DESCRIPTION OF THE DRAWINGS

One embodiment of the invention will be explained in the following with the aid of two Figures in more detail.

It is shown in.

DESCRIPTION OF PREFERRED EMBODIMENTS

Figure 1:
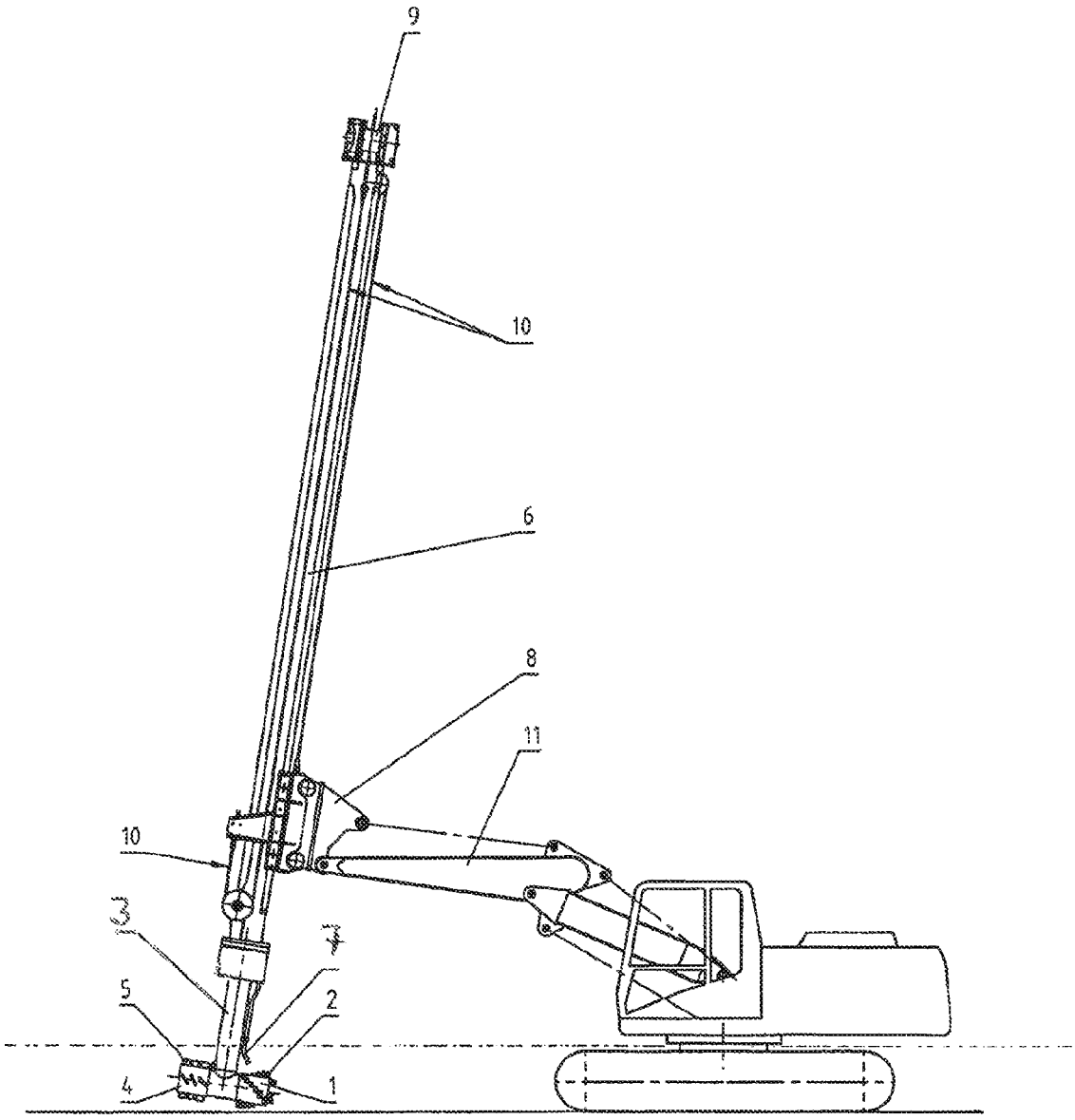
FIG. 1 an excavator with device for cutting and mixing.

FIG. 1 shows a hydraulic excavator with a device for cutting and mixing soil which is substantially comprised of a cutting drum 1 with cutting or breaking tools 2, a mixing drum 4 with mixing vanes 5, a shaft housing 3 arranged there between, and a connecting housing 3*a* adjoining the shaft housing 3 that at the topside is connected to a lifting mast 6. The lifting mast 6 has at the topside a lifting winch 9 and is connected by means of a guide unit 8 to the excavator 11.

Figure 2:
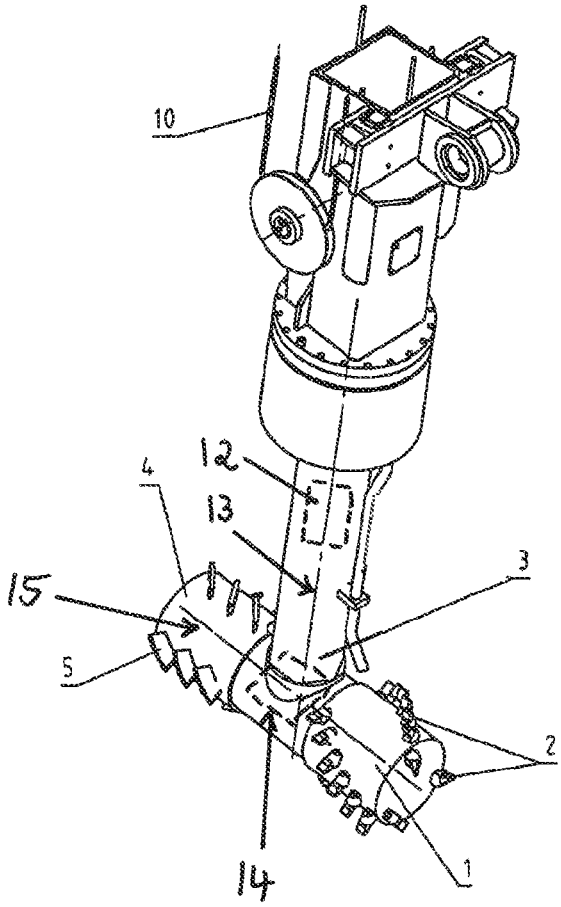
FIG. 2 a detail illustration of the cutting and mixing drum.

FIG. 2 shows a detail illustration of the cutting drum 1, the mixing drum 4 ,and the shaft housing 3 that is connected at the top to the lifting mast 6.

The leading cutting drum 6, viewed in advancing direction, is provided at the end face with several easily exchangeable cutting tools 2 for end face cutting and has on its circumference a number of spirally arranged, displaced cutting tools 2. The common vertical drive shaft 13 is supported in the shaft housing 3 and drives a conical gear unit 14, not illustrated in detail.

On the other end of the drive shaft there is the mixing drum 4 having on its circumference a number of exchangeable mixing vanes 5 arranged in a coil shape such that the cut soil material is conveyed in the direction of the already produced trench and at the same time an intimate mixing with water and the stabilization medium is realized that is supplied through the medium lines 7 arranged on the shaft housing 3. The device is mounted on an excavator 11.

The formation of a flowably adjusted clay suspension is assisted as a result of the shearing forces acting within the mixing stream. Because of the advantageous superposition of the cutting movement, the advancing movement and the mixing drum 4 rotating within the same medium, a continuous and homogenous trench filling is realized, and its extension and dimensions are ensured necessarily.

The shaft housing 3 accommodates the hydraulic drive motor 12 supported at the upper end as well as the drive shafts 15 their bearings as well as the sealing elements for the cutting and mixing drums 1 and 4 and transmits at the same time through the housing wall the occurring forces and moments into the vertically movable lifting mast 6. On the lifting mast 6 and on the shaft housing 3 the supply lines 7 for suspension, water and/or lime cement powder are arranged.

The box-shaped lifting mast is supported in a guide unit 8. The vertical advancing movement of the cutting and mixing device is realized by hydraulic winches 9 mounted on the lifting mast 6.

The guide unit 8 is mounted on the basic boom or a special lateral support frame of an excavator 11 and is moved by means of the one tilting cylinder. The selection of the excavator depends with respect to power output on the soil type and with respect to weight on the length and weight of the lifting mast.

For use at the construction site the excavator is aligned with the mounted cutting and mixing device in the direction of the trench.

For starting work, a starter pit of the desired depth is required which enables lowering of the lifting mast 6 at an angle of approximately 60°-85°. The starter pit is filled with water and aggregate material and by movement of the lifting mast 6 with the cutting and mixing unit is processed to a liquid mass 12. The working advancement of the device is realized by boom adjustment and movement of the excavator.

With the cable 10 and the boom the lifting mast 6 is placed into the starter pit for starting the cutting action.

By superposition of the rotational movement of the cutting drum 1, that cuts with the end face and circumferentially, and the vertical advancing movement of the lifting mast 6, across the working depth a soil strip is processed at a width that corresponds to the diameter of the cutting drum 1. The horizontal advancement of the device is realized by continuous or stepwise movement of the excavator.

During cutting, water and stabilization medium (lime, cement, clay) are supplied immediately to the working area through the medium lines 7 which extend along the lifting mast 6 and in the shaft housing 3.

List of Reference Numerals

1 cutting drum
2 cutting or breaking tool
3 shaft housing
4 mixing drum
5 vane
6 lifting mast
7 medium line
8 guide unit
9 lifting winch
10 cable
11 excavator

What is claimed is:

1. Device for cutting and mixing soils by means of a hydraulic excavator with a rotating or oscillating cutting drum and a rotating or oscillating mixing drum, wherein the cutting drum has an axis of rotation that is coaxial to an axis of rotation of the mixing drum, wherein the cutting drum is positioned in front of the mixing drum in an advancing direction of the device and has an end face facing in the advancing direction, wherein the cutting drum has cutting and/or breaking tools arranged on the end face of the cutting drum and on a circumferential surface of the cutting drum and configured such that material loosened by the cutting drum is moved by the cutting and/or breaking tools into the area of the mixing drum in a direction opposite to the advancing direction.

2. Device according to claim 1, wherein the cutting and/or breaking tools on the end face are positioned close to a circumference of the end face and wherein the cutting and/or breaking tools arranged on the circumferential surface form a spiral line and convey in a direction toward a shaft housing.

3. Device according to claim 1 wherein on a circumferential surface of the mixing drum vanes are arranged such that a volume stream is produced that is oriented axially opposite to the advancing direction of the device and such that the loosened material is mixed with aggregates and water, supplied to the mixing drum, to a liquid mass.

4. Device according to claim 1 comprising a shaft housing and a common drive shaft arranged in the shaft housing, wherein the cutting and the mixing drums are arranged on the common drive shaft.

5. Device according to claim 4, comprising a conical gear set and a vertical shaft, wherein the common drive shaft for the cutting drum and the mixing drum is driven by the conical gear set and the vertical shaft,

6. Device according to claim 5, comprising a drive motor arranged in an upper area of the shaft housing and wherein the drive motor acts drivingly on the vertical shaft, and further comprising a connecting surface for connecting to a lifting mast or to an adapter of a boom, wherein the connecting surface is arranged in the upper area of the shaft housing.

7. Device according to claim 4, comprising medium lines for water and aggregate, wherein the medium lines are arranged on or in the shaft housing and open at a center plane of the cutting and mixing drums.

8. Device according to claim 1, comprising a lifting mast that is supported in a guide unit and is movable by cables.

9. Device according to claim 8, wherein the guide unit is supported on the boom of a hydraulic excavator so as to be pivotable in a vertical plane that is positioned in a direction of a trench axis or on a support frame at the front end of the hydraulic excavator or laterally on the carriage of the hydraulic excavator.

* * * * *